US006368226B1

(12) United States Patent
Gibson

(10) Patent No.: US 6,368,226 B1
(45) Date of Patent: Apr. 9, 2002

(54) CONICAL RECREATIONAL DEVICE

(76) Inventor: Robert Gibson, 366 Elmwood Ave., Buffalo, NY (US) 14222

( * ) Notice: Subject to any disclaimer, the term of this patent is extended or adjusted under 35 U.S.C. 154(b) by 0 days.

(21) Appl. No.: 09/881,874

(22) Filed: Jun. 15, 2001

(51) Int. Cl.[7] ..... A63G 1/12

(52) U.S. Cl. ..... 472/25; 472/26; 472/135; 280/205

(58) Field of Search ..... 472/14, 25, 26, 472/135; 280/205, 206, 207; 482/142, 146

(56) References Cited

U.S. PATENT DOCUMENTS

| | | | | | |
|---|---|---|---|---|---|
| 2,878,858 | A | * | 3/1959 | Winchester | 114/363 |
| 3,262,701 | A | * | 7/1966 | Howland | 220/669 |
| 3,460,828 | A | | 8/1969 | Curlee | |
| 3,586,321 | A | * | 6/1971 | Gehrke et al. | 472/14 |
| 3,905,617 | A | | 9/1975 | Smith | |
| 4,076,235 | A | * | 2/1978 | Risberg, Jr. | 472/135 |
| 4,364,579 | A | | 12/1982 | Fisher | |
| 4,458,895 | A | | 7/1984 | Turcotte | |
| D347,248 | S | | 5/1994 | Franzman | |
| D392,012 | S | | 3/1998 | Loiselle et al. | |
| 5,951,403 | A | * | 9/1999 | Trzos | 472/102 |

* cited by examiner

*Primary Examiner*—Kien T. Nguyen

(57) ABSTRACT

A conical recreational device for providing recreation and exercise. The conical recreational device includes a tubular housing having a first open end and a second open end. The tubular housing has a generally frusto-conical shape. A peripheral lip is attached to and extends around an edge of the first open end. A sleeve for extending into the first open end of the housing has a first end, a second end and a peripheral wall extending between the first and second ends. The first end of the sleeve is open and has a perimeter edge has a flange thereon. The flange comprises a hook extending toward the second end. The flange may be extended over the lip on the housing for rotationally coupling the sleeve to the housing.

10 Claims, 6 Drawing Sheets

CONICAL RECREATIONAL DEVICE

BACKGROUND OF THE INVENTION

1. Field of the Invention

The present invention relates to recreational toy devices and more particularly pertains to a new conical recreational device for providing recreation and exercise.

2. Description of the Prior Art

The use of recreational toy devices is known in the prior art. More specifically, recreational toy devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,458,895; 3,905,617; 4,364,579; 4,460,828; U.S. Pat. No. Des. 347,248; U.S. Pat. No. Des. 392,012.

While these devices fulfill their respective, particular objectives and requirements, the aforementioned patents do not disclose a tubular housing having a first open end and a second open end. The tubular housing has a generally frusto-conical shape. A peripheral lip is attached to and extends around an edge of the first open end. A sleeve for extending into the first open end of the housing has a first end, a second end and a peripheral wall extending between the first and second ends. The first end of the sleeve is open and has a perimeter edge has a flange thereon. The flange comprises a hook extending toward the second end. The flange may be extended over the lip on the housing for rotationally coupling the sleeve to the housing.

In these respects, the conical recreational device according to the present invention substantially departs from the conventional concepts and designs of the prior art, and in so doing provides an apparatus primarily developed for the purpose of providing recreation and exercise.

SUMMARY OF THE INVENTION

In view of the foregoing disadvantages inherent in the known types of recreational toy devices now present in the prior art, the present invention provides a new conical recreational device construction wherein the same can be utilized for providing recreation and exercise.

The general purpose of the present invention, which will be described subsequently in greater detail, is to provide a new conical recreational device apparatus and method which has many of the advantages of the recreational toy devices mentioned heretofore and many novel features that result in a new conical recreational device which is not anticipated, rendered obvious, suggested, or even implied by any of the prior art recreational toy devices, either alone or in any combination thereof.

To attain this, the present invention generally comprises a tubular housing having a first open end and a second open end. The tubular housing has a generally frusto-conical shape. A peripheral lip is attached to and extends around an edge of the first open end. A sleeve for extending into the first open end of the housing has a first end, a second end and a peripheral wall extending between the first and second ends. The first end of the sleeve is open and has a perimeter edge has a flange thereon. The flange comprises a hook extending toward the second end. The flange may be extended over the lip on the housing for rotationally coupling the sleeve to the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new conical recreational device apparatus and method which has many of the advantages of the recreational toy devices mentioned heretofore and many novel features that result in a new conical recreational device which is not anticipated, rendered obvious, suggested, or even implied by any of the prior art recreational toy devices, either alone or in any combination thereof.

It is another object of the present invention to provide a new conical recreational device which may be easily and efficiently manufactured and marketed.

It is a further object of the present invention to provide a new conical recreational device which is of a durable and reliable construction.

An even further object of the present invention is to provide a new conical recreational device which is susceptible of a low cost of manufacture with regard to both materials and labor, and which accordingly is then susceptible of low prices of sale to the consuming public, thereby making such conical recreational device economically available to the buying public.

Still yet another object of the present invention is to provide a new conical recreational device which provides in the apparatuses and methods of the prior art some of the advantages thereof, while simultaneously overcoming some of the disadvantages normally associated therewith.

Still another object of the present invention is to provide a new conical recreational device for providing recreation and exercise.

Yet another object of the present a tubular housing having a first open end and a second open end. The tubular housing has a generally frusto-conical shape. A peripheral lip is attached to and extends around an edge of the first open end. A sleeve for extending into the first open end of the housing has a first end, a second end and a peripheral wall extending between the first and second ends. The first end of the sleeve is open and has a perimeter edge has a flange thereon. The flange comprises a hook extending toward the second end. The flange may be extended over the lip on the housing for rotationally coupling the sleeve to the housing.

Still yet another object of the present invention is to provide a new conical recreational device that is conical shape such that the device spins only in a circle for the protection of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
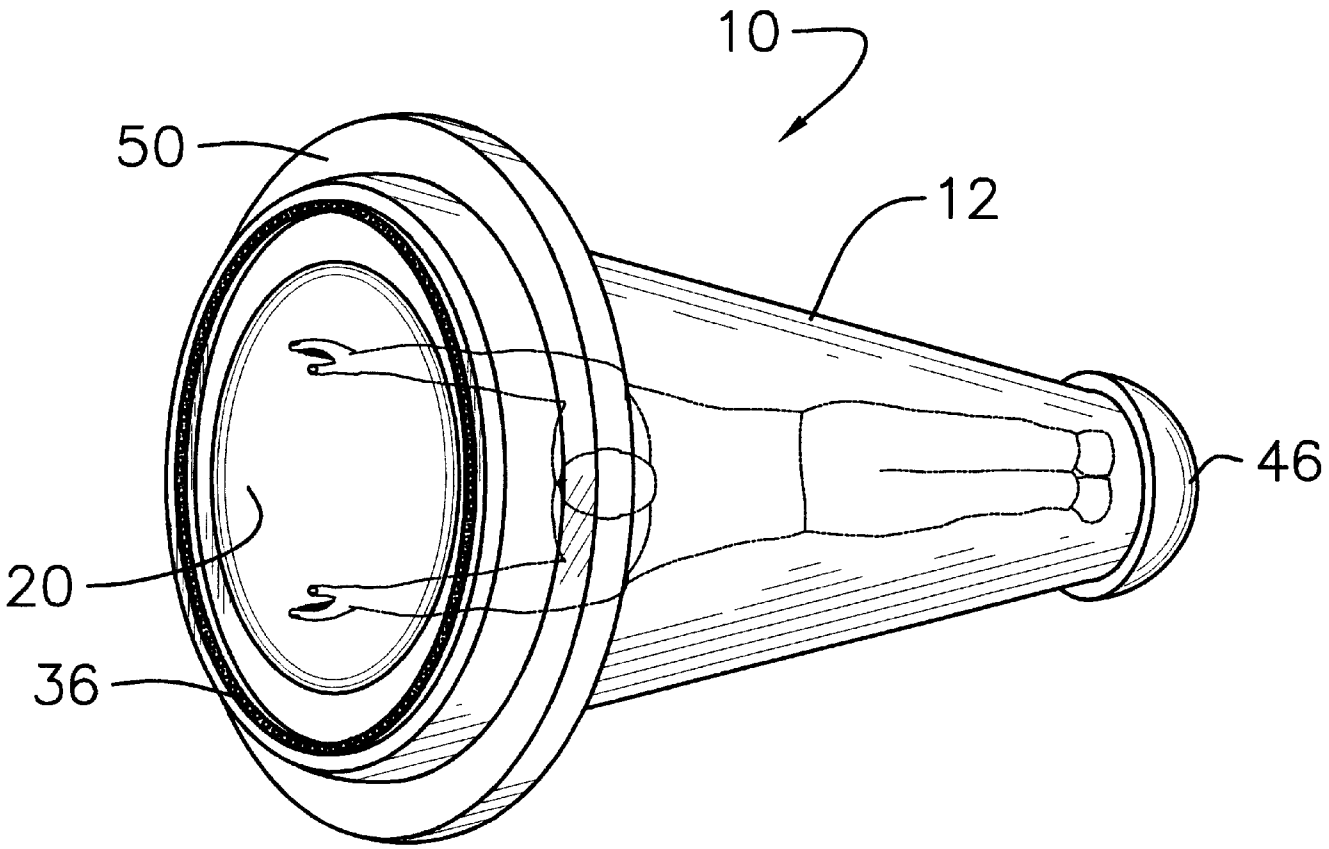
FIG. 1 is a schematic perspective view of a new conical recreational device according to the present invention.
Figure 2:
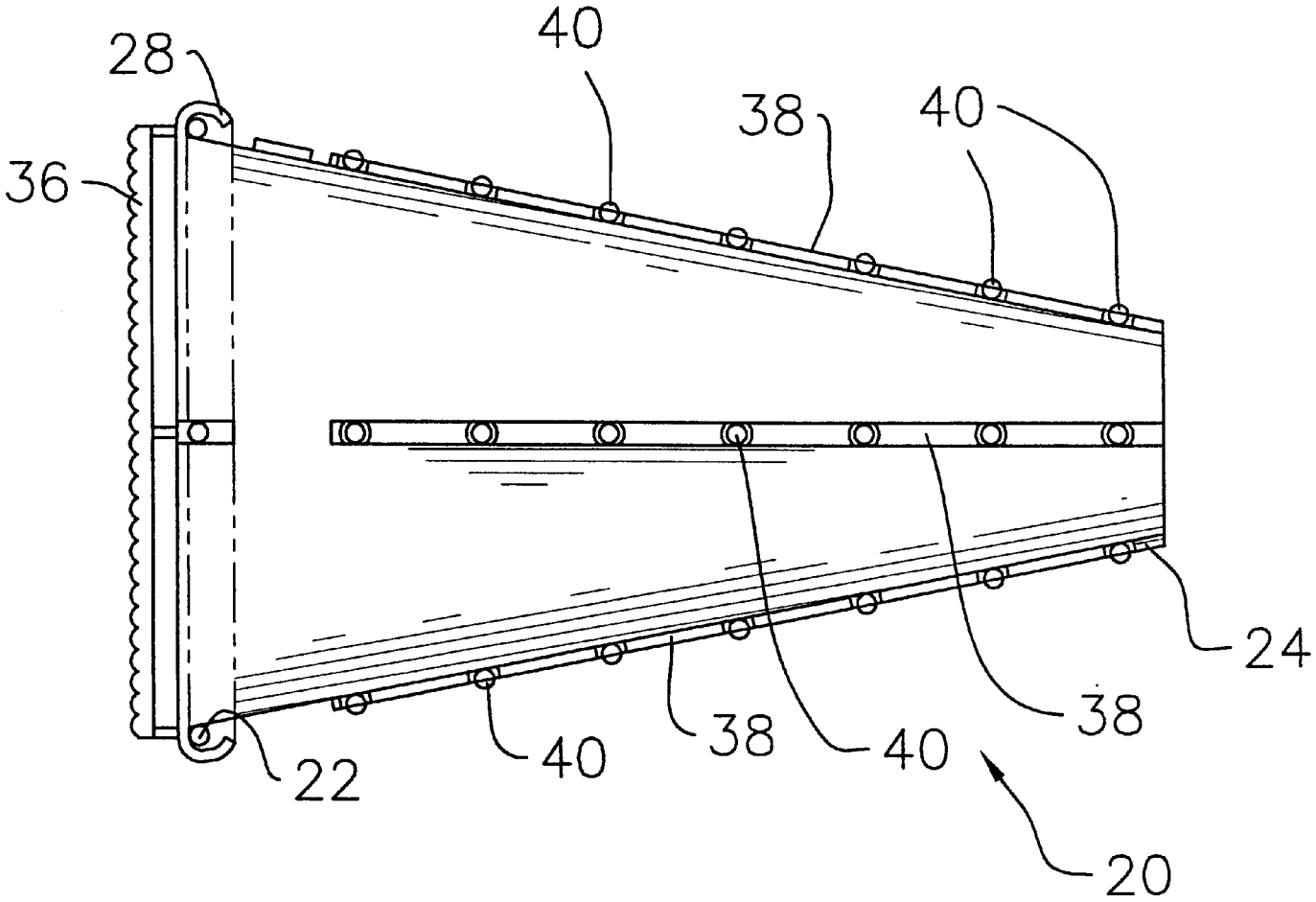
FIG. 2 is a schematic side view of the present invention.
Figure 3:
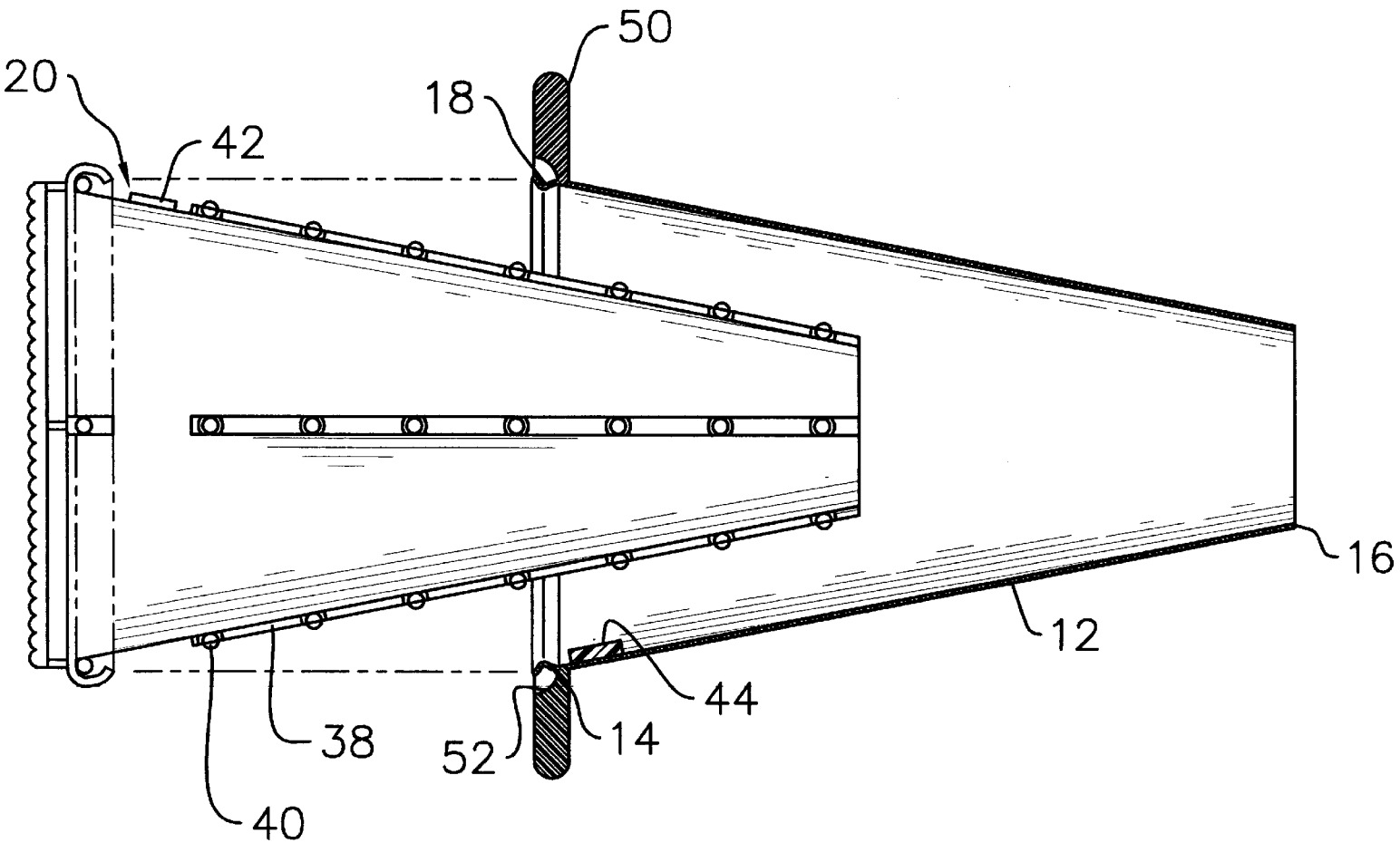
FIG. 3 is a schematic side view of the present invention.
Figure 4:
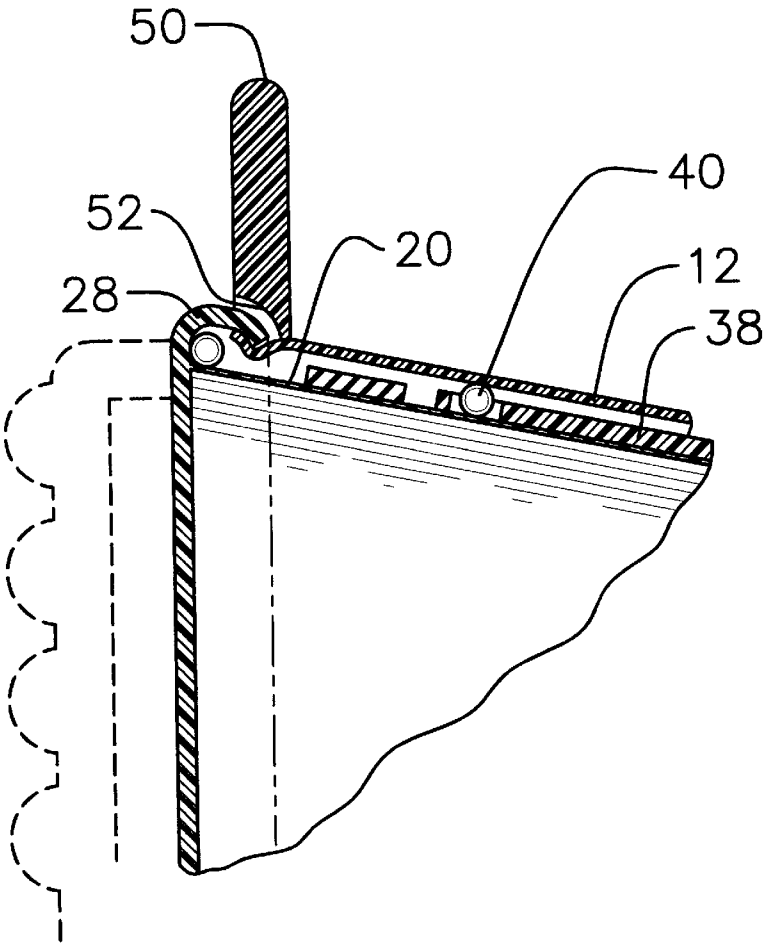
FIG. 4 is a schematic cross-sectional side view of the present invention.
Figure 5:
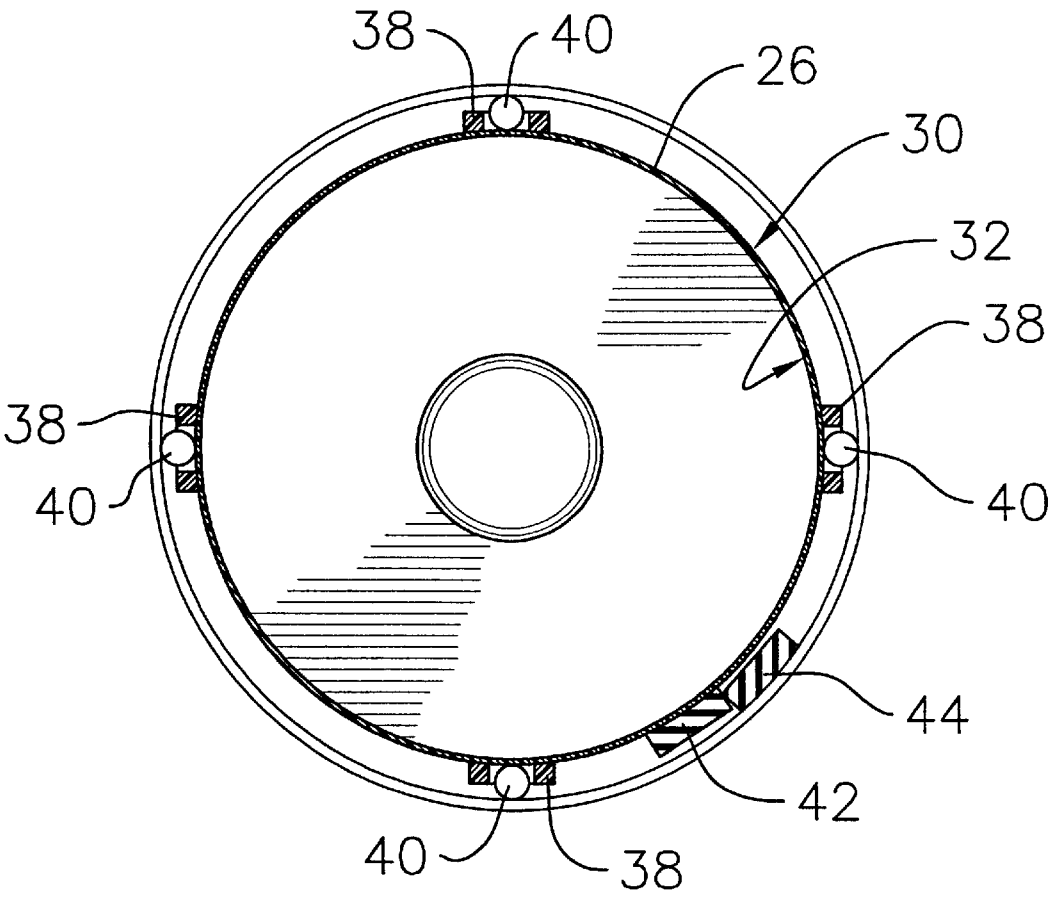
FIG. 5 is a schematic cross-sectional end view of the present invention.
Figure 6:
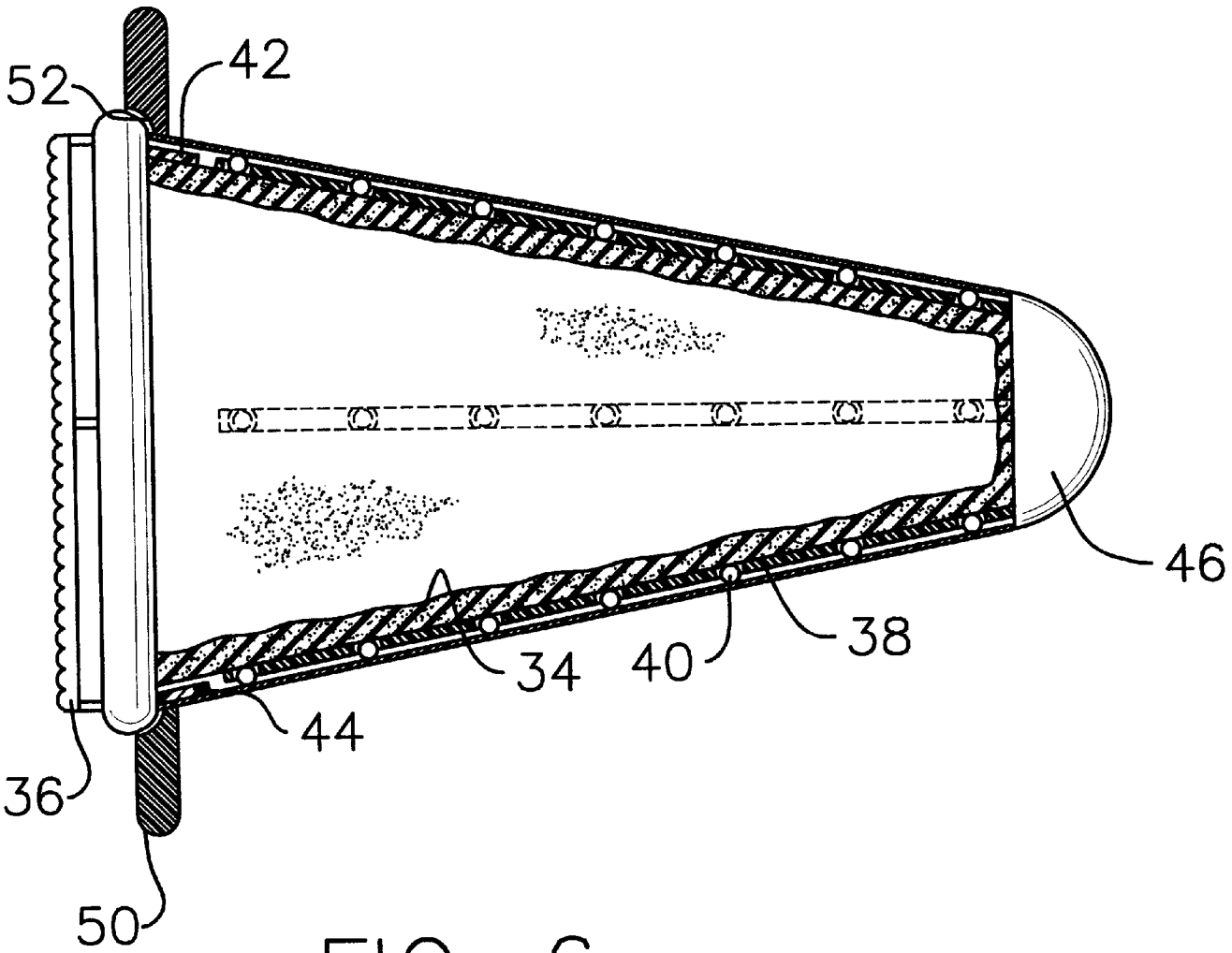
FIG. 6 is a schematic cross-sectional side view of the present invention.

With reference now to the drawings, and in particular to FIGS. 1 through 6 thereof, a new conical recreational device embodying the principles and concepts of the present invention and generally designated by the reference numeral 10 will be described.

As best illustrated in FIGS. 1 through 6, the conical recreational device 10 generally comprises a tubular housing 12 having a first open end 14 and a second open end 16. The tubular housing 12 has a generally frusto-conical shape. A peripheral lip 18 is attached to and extends around an edge of the first open end 14. The first open end 14 has a diameter preferably between 2.5 feet and 3.5 feet. The second open end has a diameter preferably between 1 foot and 2 feet. The housing 12 has a length from the first open end to the second open end preferably generally equal to 4 feet.

A sleeve 20 for extending into the first open end 14 of the housing 20 has a first end 22, a second end 24 and a peripheral wall 26 extending between the first 22 and second 24 ends. The peripheral wall 26 has an outer diameter and shape substantially equal to an inner diameter and shape of the housing 12 such that the first end 22 of the sleeve 20 has a diameter greater than a diameter of the second end 24. The first end 22 of the sleeve 20 is open and has a perimeter edge having a flange 28 thereon. The flange 28 comprises a hook extending toward the second end 24. The flange 28 may be extended over the lip 18 on the housing 20 when the sleeve 20 is extended into housing 12 for holding the sleeve 20 to the housing 12 such that the sleeve 20 is rotational with respect to the housing 12. The peripheral wall 26 has an outer surface 30 and an inner surface 32. A cushioning material 34 is attached to and generally covers the inner surface 32 of the sleeve 20. The cushioning material 34 preferably comprises a foamed elastomeric material. A neck 36 is attached to and extends away from the perimeter edge of the first end. The neck 36 has a ribbed outer edge and defines a handgrip.

A plurality of elongated ridges 38 is attached to and extends outwardly from the peripheral wall 26 of the sleeve 20. The ridges 38 are orientated generally parallel to lines extending between the first 22 and second ends 24 of the sleeve 20. A plurality of bearings 40 are rotatably disposed in each of the ridges 38 and extend outwardly away from the ridges 38 such that the bearings 40 are in contact with an inner surface of the housing 12 for enhancing rotation of the sleeve 20 with respect to the housing 12.

A pair of stops prevent rotation of the sleeve 20 beyond 360 degrees with respect to the housing 12. A first of the stops 42 is attached to the outer surface 30 of the sleeve 20 and is positioned generally adjacent to the first end 22 of sleeve 20. A second of the stops 44 is attached to the inner surface of the housing 12 and is positioned generally adjacent to the first open end 14. The stops 42, 44 are preferably comprised of an elastomeric material.

A cover 46 for positioning over the second open end 16 of the housing 12 has a hemispherical shape such that the cover 46 has a convex outer surface. The cover 46 is attached to the housing 12 such that the cover 46 covers the second open end 16 of the housing 12.

Ideally an annular support member 50 is attached to and extends around the housing 12. The support member is adjacent to the first open end 14 and extends over the lip 18. An annular cavity 52 is positioned between the support member 50 and the lip 18. The flange is extendable into the cavity 52 for engaging the lip 18.

In use, a child climbs into the sleeve 20 and holds onto the handle 36. Moving their body back and forth causes the sleeve 20 to rotate within the housing 12. Simultaneously, the housing 12 may be rotated. The housing 12 has a conical shape and thus will only spin a circle. The flange 28 extends radially away from the sleeve 20 to provide clearance between the ground and the neck 36 for a child to safely grip the neck. The support member 50 increases the clearance and enhances the motion of the housing 12. The stops 42, 44 prevent the sleeve 20 from continuously spinning.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toy for movement in a circle on the ground comprising:

a tubular housing having a first open end and a second open end, said tubular housing having a generally frusto-conical shape, a peripheral lip being attached to and extending around an edge of said first open end; and a sleeve for extending into said first open end of said housing, said sleeve having a first end, a second end and a peripheral wall extending between said first and second ends, said first end of said sleeve being open and having a perimeter edge having a flange thereon, said flange comprising a hook extending toward said second end, wherein said flange adapted to be extended over said lip on said housing when said sleeve is extended into said housing such that said sleeve is rotational with respect to said housing.

2. The toy as in claim 1, wherein said first open end of said housing has a diameter generally between 2.5 feet and 3.5 feet, said second open end having a diameter generally between 1 foot and 2 feet, said housing having a length from said first open end to said second open end generally equal to 4 feet.

3. The toy as in claim 1, wherein said peripheral wall of said sleeve has an outer diameter and shape substantially equal to an inner diameter and shape of said housing such that said first end of said sleeve has a diameter greater than a diameter of said second end.

4. The toy as in claim 1, wherein said peripheral wall has an outer surface and an inner surface, a cushioning material being attached to and generally covering said inner surface of said sleeve.

5. The toy as in claim 1, wherein said sleeve further includes a neck being attached to and extending away from said perimeter edge of said first end, said neck having a ribbed outer edge, said neck defining a handgrip.

6. The toy as in claim 1, further including a plurality of elongated ridges being to and extending outwardly from said peripheral wall of said sleeve, said ridges being orientated generally parallel to lines extending between said first and second ends of said sleeve, a plurality of bearings being rotatably disposed in each of said ridges and extending outwardly away from said ridges such that said bearings are in contact with an inner surface of said housing for enhancing rotation of said sleeve with respect to said housing.

7. The toy as in claim 6, further including a pair of stops for preventing rotation of said sleeve beyond 360 degrees with respect to said housing, a first of said stops being attached to an outer surface of said sleeve and positioned generally adjacent to said first end of sleeve, a second of said stops being attached to an inner surface of said housing and positioned generally adjacent to said first open end.

8. The toy as in claim 1, further including a cover for positioning over said second open end of said housing, said cover having a hemispherical shape such that said cover has a convex outer surface, said cover being attached to said housing such that said cover covers said second open end of said housing.

9. The toy as in claim 1, further including an annular support member being attached to and extending around an outer surface of said housing, said support member being positioned adjacent to said open end, said support member extending over said lip, an annular cavity being positioned between said support member and said lip, wherein said flange is extendable into said cavity for engaging said lip.

10. A toy for movement in a circle on the ground comprising:

a tubular housing having a first open end and a second open end, said tubular housing having a generally frusto-conical shape, a peripheral lip being attached to and extending around an edge of said first open end, said first open end having a diameter generally between 2.5 feet and 3.5 feet, said second open end having a diameter generally between 1 foot and 2 feet, said housing having a length from said first open end to said second open end generally equal to 4 feet;

a sleeve for extending into said first open end of said housing, said sleeve having a first end, a second end and a peripheral wall extending between said first and second ends, said peripheral wall having an outer diameter and shape substantially equal to an inner diameter and shape of said housing such that said first end of said sleeve has a diameter greater than a diameter of said second end, said first end of said sleeve being open and having a perimeter edge having a flange thereon, said flange comprising a hook extending toward said second end, wherein said flange adapted to be extended over said lip on said housing when said sleeve is extended into said housing such that said sleeve is rotational with respect to said housing, said peripheral wall having an outer surface and an inner surface, a cushioning material being attached to and generally covering said inner surface of said sleeve, a neck being attached to and extending away from said perimeter edge of said first end, said neck having a ribbed outer edge, said neck defining a handgrip;

a plurality of elongated ridges being attached to and extending outwardly from said peripheral wall of said sleeve, said ridges being orientated generally parallel to lines extending between said first and second ends of said sleeve, a plurality of bearings being rotatably disposed in each of said ridges and extending outwardly away from said ridges such that said bearings are in contact with an inner surface of said housing for enhancing rotation of said sleeve with respect to said housing;

a pair of stops for preventing rotation of said sleeve beyond 360 degrees with respect to said housing, a first of said stops being attached to said outer surface of said sleeve and positioned generally adjacent to said first end of sleeve, a second of said stops being attached to said inner surface of said housing and positioned generally adjacent to said first open end;

a cover for positioning over said second open end of said housing, said cover having a hemispherical shape such that said cover has a convex outer surface, said cover being attached to said housing such that said cover covers said second open end of said housing; and an annular support member being attached to and extending around an outer surface of said housing, said support member being positioned adjacent to said open end, said support member extending over said lip, an annular cavity being positioned between said support member and said lip, wherein said flange is extendable into said cavity for engaging said lip.

* * * * *